US012385327B2

(12) United States Patent
Horn et al.

(10) Patent No.: US 12,385,327 B2
(45) Date of Patent: Aug. 12, 2025

(54) DOWNHOLE APPARATUS

(71) Applicant: DeltaTek Oil Tools Limited, Aberdeen (GB)

(72) Inventors: Tristam Paul Horn, Westhill (GB); Stephen Edmund Bruce, Blairgowrie (GB); David Michael Shand, Banchory (GB); Tyler Rhes Reynolds, Magnolia, TX (US)

(73) Assignee: EXPRO NORTH SEA LIMITED, Dyce (GB)

( * ) Notice: Subject to any disclaimer, the term of this patent is extended or adjusted under 35 U.S.C. 154(b) by 38 days.

(21) Appl. No.: 18/265,395

(22) PCT Filed: Dec. 1, 2021

(86) PCT No.: PCT/GB2021/053139

§ 371 (c)(1),
(2) Date: Jun. 5, 2023

(87) PCT Pub. No.: WO2022/118018

PCT Pub. Date: Jun. 9, 2022

(65) Prior Publication Data

US 2024/0052712 A1 Feb. 15, 2024

(30) Foreign Application Priority Data

Dec. 4, 2020 (GB) ..... 2019183

(51) Int. Cl.

| | |
|---|---|
| ***E21B 17/06*** | (2006.01) |
| ***E21B 33/12*** | (2006.01) |
| ***E21B 33/13*** | (2006.01) |
| ***E21B 37/04*** | (2006.01) |
| ***E21B 43/10*** | (2006.01) |

(52) U.S. Cl.

CPC ..... *E21B 17/06* (2013.01); *E21B 33/12* (2013.01); *E21B 33/13* (2013.01); *E21B 37/045* (2013.01); *E21B 43/10* (2013.01)

(58) Field of Classification Search

CPC ..... E21B 17/06; E21B 33/12; E21B 33/13; E21B 37/045; E21B 43/10; E21B 33/14; E21B 33/16; E21B 23/0413; E21B 17/02; E21B 41/00; E21B 41/0021

See application file for complete search history.

(56) References Cited

U.S. PATENT DOCUMENTS 4,966,236 A * 10/1990 Braddick ..... E21B 43/10 166/291
5,413,172 A * 5/1995 Laurel ..... E21B 33/16 166/153

(Continued)

FOREIGN PATENT DOCUMENTS

GB 2376252 B 11/2003
WO 9103620 W 3/1991

(Continued)

*Primary Examiner* — Steven A MacDonald
(74) *Attorney, Agent, or Firm* — Getz Balich LLC

(57) ABSTRACT

A coupling connects an inner string to a lower end of a bore-lining tubing, such as a liner. The coupling includes a catcher and may be provided in combination with at least one member for translating through the inner string and landing in the catcher. The member may be an occluding member, such as a ball for occluding a flow passage through the coupling.

19 Claims, 10 Drawing Sheets

(56) References Cited

U.S. PATENT DOCUMENTS

| | | | | |
|---|---|---|---|---|
| 6,318,472 | B1 * | 11/2001 | Rogers | E21B 33/16 166/212 |
| 9,279,295 | B2 * | 3/2016 | Williamson | E21B 21/10 |
| 2002/0185281 | A1 * | 12/2002 | Buzinsky | E21B 43/10 166/380 |
| 2003/0070816 | A1 * | 4/2003 | Sullaway | E21B 43/10 166/380 |
| 2004/0221997 | A1 * | 11/2004 | Giroux | E21B 33/143 166/380 |
| 2008/0149336 | A1 | 6/2008 | Szarka | |
| 2010/0132954 | A1 * | 6/2010 | Telfer | E21B 34/142 166/373 |
| 2014/0352944 | A1 * | 12/2014 | Devarajan | E21B 23/02 166/138 |
| 2018/0135378 | A1 * | 5/2018 | Budde | E21B 23/04 |
| 2018/0258731 | A1 * | 9/2018 | Budde | E21B 43/10 |

FOREIGN PATENT DOCUMENTS

| | | | |
|---|---|---|---|
| WO | 2016191578 | A1 | 12/2016 |
| WO | 2017023911 | A1 | 2/2017 |

* cited by examiner

DOWNHOLE APPARATUS

This application claims priority to PCT Patent Appln. No. PCT/GB2021/053139 filed Dec. 1, 2021, which claims priority to Great Britain Patent Appln. No. 2019183.9 filed Dec. 4, 2020, which are hereby incorporated herein by reference in their entireties.

BACKGROUND OF THE INVENTION

1. Technical Field

This disclosure relates to apparatus and methods for use in cementing tubulars in bores, for example in cementing casing or liner in a bore drilled to access an underground hydrocarbon-bearing formation.

2. Background Information

In the oil and gas exploration and extraction industry bores are drilled from surface to access hydrocarbon-bearing rock formations. The drilled bores are lined with metal tubing, known as casing and liner. The annular space between the bore-lining tubing and the surrounding bore wall is sealed with cement. A cement slurry is prepared on surface and pumped down through the tubing. The cement slurry exits the lower end of the tubing and flows up into the annular space, where the slurry sets.

Applicant has disclosed arrangements in which a smaller diameter inner string of tubing is provided within the bore-lining tubing. See, for example, GB2545495, WO2017103601, WO2018042148, GB2565098, WO2019025798, WO2019025799, GB1911653.2, and GB2003477.3 the disclosures of which are incorporated herein in their entirety. Cement slurry may be pumped down through the inner string and into the annular space around the tubing. The inner string may subsequently be retrieved from the cemented tubing.

SUMMARY

An aspect of the disclosure relates to a coupling for connecting an inner string to a lower end of a bore-lining tubing, the coupling including a catcher.

The coupling may be provided in combination with at least one member for translating through the inner string and landing in the catcher. The at least one member may be an occluding member and the coupling may include a seat for cooperating with an occluding member, which occluding member may be displaceable to the catcher.

The coupling may be provided at a lower end of the bore-lining tubing and may be adapted to engage with a lower end of the inner string. The coupling may be adapted to receive a lower end of the inner string, and thereby may provide a continuous small diameter conduit which extends to the end of the bore-lining tubing.

The coupling or inner string may include an open equalizing port to balance pressure between the inside of the inner-string and an inner annulus formed between the inner-string and the bore-lining tubing.

According to another aspect of the present disclosure there is provided a downhole method comprising: coupling a lower end of an inner string to a lower end of a bore-lining tubing to form a tubing assembly; then translating at least one member through the inner string to a catcher in a lower end of the assembly, and then flowing fluid through the inner string and out of the bore-lining tubing.

The tubing assembly may be run into a drilled bore to locate the bore-lining tubing at a target depth in the bore.

The at least one member may be translated from surface.

The at least one member may be an occluding member such as a ball, dart, or plug. The occluding member may be displaceable from an occluding position, for example the member may be held in an occluding position to occlude the inner string to allow the inner string above the member to be pressurized, and the member may then be displaced from the occluding position into the catcher. The member may occlude the lower end of the inner string. The member may be displaceable through a seat, or the member may engage with a seat and the seat and ball may be displaceable. The method may further comprise the step of pressurizing the inner string above the occluding member to activate a tool or device, for example to set a hanger or packer associated with the bore-lining tubing.

Alternatively, or in addition, the at least one member may be a string cleaning member or a fluid-separating member for location between two different fluids, for example the member may separate a leading bore-conditioning fluid from a trailing chemical wash, or the member may separate a leading chemical wash from a trailing cement spacer fluid, or the member may separate a leading cement spacer fluid from a following cement slurry, or the member may separate a leading cement slurry from a following displacement fluid.

The method may further comprise translating an occluding member through the inner string to occlude the string and prevent further fluid from flowing from the inner string and out of the end of the bore-lining tubing. The occluding member may also serve to separate two fluids, for example the member may separate a leading cement slurry from a following displacement or cleaning fluid. The occluding member may include anchoring portions to secure the occluding member in the inner string or within the catcher.

One or both of a float shoe and a float collar may be provided at the lower end of the bore-lining tubing. The lower end of the inner string may engage with the float shoe or float collar.

The method may further comprise uncoupling the inner string from the bore-lining tubing. In one example this may involve rotation of the lower end of the inner string relative to a coupling, in another example this de-coupling may be by vertical movement of the lower end of the inner string relative to a coupling.

The method may further comprise retrieving the inner string from the bore. One or more of the coupling, the catcher, and any members in the catcher, may remain in the bore with the bore-lining tubing.

According to a further aspect of the present disclosure there is provided a downhole method comprising: (a) coupling a lower end of an inner string to a lower end of a bore-lining tubing to form a tubing assembly; (b) running the tubing assembly into a bore with the assembly configured to permit circulation of fluid down through the inner string and out of the lower end of the bore-lining tubing; (c) configuring the assembly to prevent flow of fluid out of the lower end of the bore-lining tubing; (d) configuring the assembly to permit the circulation of fluid and to permit passage of at least one member through the inner string and to the end of the bore-lining tubing; and (e) configuring the assembly to prevent flow of fluid out of the lower end of the bore-lining tubing and to prevent flow of fluid into the lower end of the bore-lining tubing.

The method may further comprise, at step (a), a method of equalizing the pressure across the inner-string by providing an open equalizing port between the inside of the inner-string and the sealed inner annulus formed between the inner-string and the bore-lining tubing The method may further comprise, at step (b), circulating fluid down through the inner string and out of the lower end of the bore-lining tubing. Such circulation of fluid may be employed to facilitate running the assembly into the bore.

The method may further comprise, at step (c), pressurizing the inner string. The elevated pressure in the inner string may be utilized to activate or actuate tools or devices operatively associated with the assembly, for example a hanger associated with the bore-lining tubing, which may be a liner.

The method may further comprise, at step (d), circulating fluid and translating at least one member through the inner string and to the end of the bore-lining tubing. The at least one member may be a string cleaning member or a fluid-separating member for location between two different fluids, for example the member may separate a leading bore-conditioning fluid from a trailing chemical wash, or the member may separate a leading chemical wash from a trailing cement spacer fluid, or the member may separate a leading cement spacer fluid from a following cement slurry, or the member may separate a leading cement slurry from a following displacement fluid.

The method may further comprise, at step (e), translating an occluding member through the inner string to occlude the string and prevent fluid from flowing from the inner string and out of the end of the bore-lining tubing. The method may further comprise separating two fluids with the occluding member, for example the member may separate a leading cement slurry from a following displacement or cleaning fluid. The method may further comprise anchoring the occluding member in the assembly with bi-directional anchoring arrangements. The method may further comprise sealing the occluding member in the assembly with bi-directional sealing arrangements.

According to another aspect of the present disclosure there is provided a method comprising: coupling an inner string having an upper end and a lower end to a bore-lining tubing to form a tubing assembly; and configuring the assembly whereby a portion of the inner string intermediate the upper and lower ends contacts the bore-lining tubing.

The disclosure also relates to an assembly comprising an inner string and a bore-lining tubing, the assembly being configured such that an intermediate portion of the inner string is in contact with the bore-lining tubing.

The method may further comprise rotating the tubing assembly in a bore. The rotation may be related to, for example: extending the bore by drilling with the tubing assembly; reducing axial friction as the tubing assembly is advanced through the bore; facilitating displacement of material in the bore; facilitating cleaning of the wall of the bore surrounding the assembly, or improving the distribution or bonding of cement slurry around the assembly. The contact between the inner string and the bore-lining tubing may limit or prevent the inner string, or portions of the inner string, from rotating relative to the bore-lining tubing. Such differential rotation may be associated with loosening of couplings in the inner string or fatigue damage or failure of the inner string.

The method may further comprise: coupling the lower end of the inner string to a lower end of the bore-lining tubing; configuring the inner string whereby the intermediate portion contacts the bore-lining tubing; and coupling the upper end of the inner string to an upper end of the bore-lining tubing.

The method may comprise compressing the inner string.

The method may comprise buckling the inner string and may comprise inducing helical buckling of the inner string.

In the various apparatus and methods described above there will be an inner annulus defined between the inner string and the surrounding bore-lining tubing. This annulus may be filled with fluid as the assembly is made up, for example the annulus may be top filled with drilling fluid. Alternatively, the annulus may be at least partially filled with a lower density liquid, such as a lower density hydrocarbon, or may be at least partially filled with air or another gas. The annulus may be provided with a divider such that, for example, a lower portion of the annulus may be filled with air, while an upper portion of the annulus may be filled with drilling fluid.

According to a still further aspect of the present disclosure there is provided a method of extending a bore, the method comprising: at least partially filling an annulus provided in a tubing assembly between an inner string and a bore-lining tubing with material having a lower density than ambient fluid in a bore; and rotating a cutting structure on a distal end of the assembly to extend the bore.

The tubing assembly may be rotated in the bore, or only a distal end portion of the tubing assembly may be rotated.

An aspect of the disclosure also relates to a downhole assembly for use in extending a bore containing an ambient fluid, the assembly comprising an inner string located within a bore-lining tubing, an annulus between the inner string and the bore-lining tubing containing a material having a density lower than the ambient fluid in the bore.

The provision of the lower density material provides the assembly with a degree of buoyancy. This may reduce the friction between the assembly and a surrounding bore wall, particularly in inclined or horizontal bores.

The inner string and the bore-lining tubing may be coaxial. Alternatively, an axis of portions of the inner string may be offset from an axis of the bore-ling tubing, or the inner string may define a wave form. In some examples an intermediate portion of the inner string will engage the bore-lining tubing to reduce or minimize the possibility of relative rotation between the inner string and the bore-lining tubing.

The steps of the methods recited herein may be performed in the order the steps are recited or may be performed in an alternative order. Further, the steps may be performed discretely, or one or more steps may overlap, or one or more steps may be performed simultaneously.

Various features and aspects as described above, and as recited in the claims below, may be combined with one or more of the other features and aspects described herein, or may have utility independently of the other features and aspects.

BRIEF DESCRIPTION OF THE DRAWINGS

These and other aspects of the disclosure will now be described, by way of example only, with reference to the accompanying drawings, in which.

DETAILED DESCRIPTION

Figure 1:
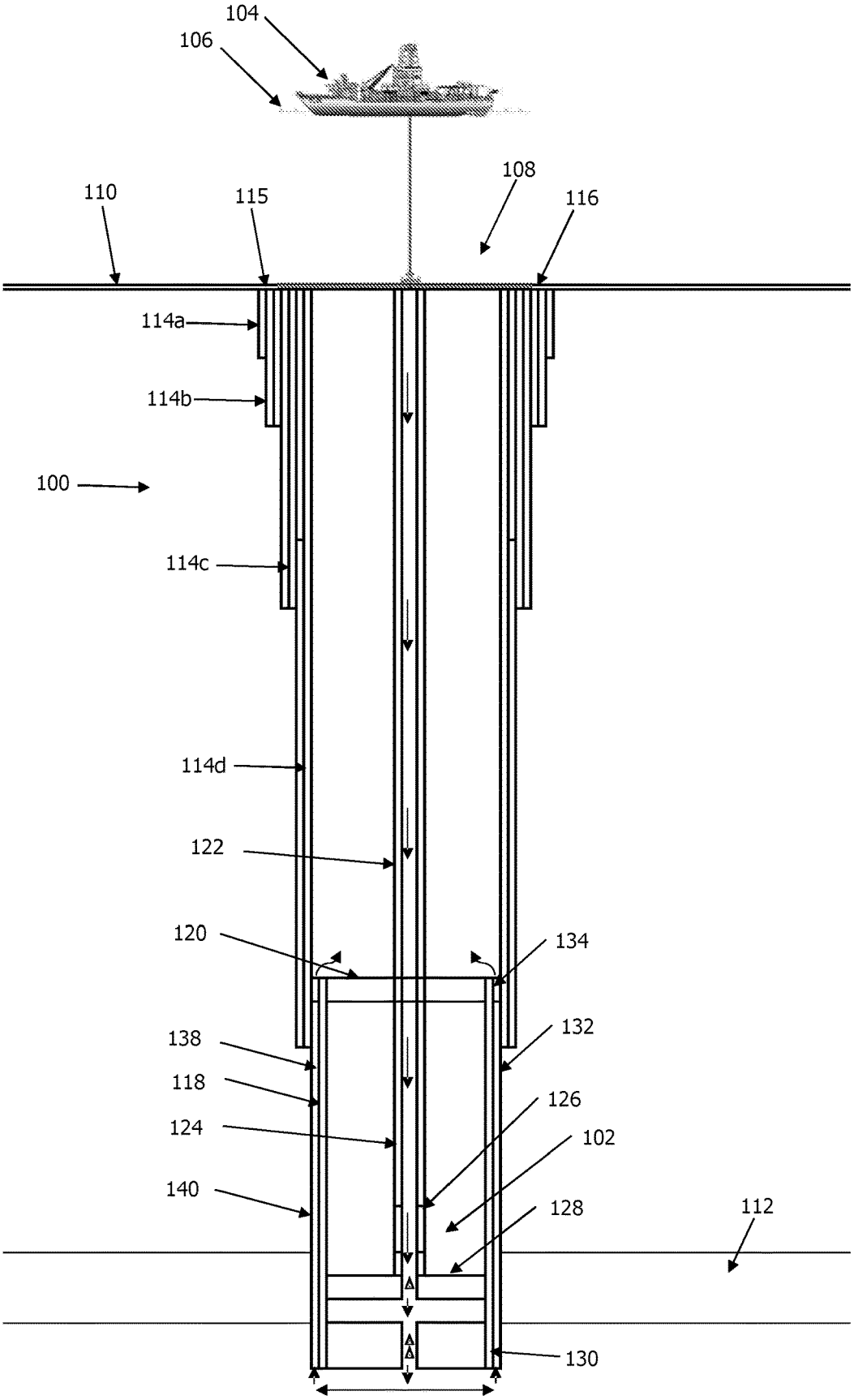
FIG. 1 is a schematic of an oil and gas well including apparatus in accordance with an example of an aspect of the present disclosure.

Reference is first made to FIG. 1 of the drawings, a schematic of an offshore oil and gas well 100 including apparatus 102 in accordance with an example of an aspect of the present disclosure. The figure illustrates a mobile offshore drilling unit (MODU) 104 on the sea surface 106 located above a bore 108 which has been drilled from the mudline or seabed 110 to access a hydrocarbon-bearing formation 112. The bore 108 has been lined with four bore-lining casing sections 114*a-d*. The annuli 115 surrounding the three innermost casings 114*b-d* have been filled and sealed with cement sheaths 116.

The figure illustrates a bore-lining tubing in the form of a liner 118 being cemented in the distal end of the bore 108. The upper or proximal end of the liner 118 is engaged by a running tool 120 which is coupled to a running string 122 extending back to the drilling unit 104. An inner string 124 is in communication with the running string 122 and extends from the running tool 120 down through the liner 118 and engages with a coupling 126 provided towards the lower or distal end of the liner 118. The coupling 126 is provided above a float collar 128 and a float shoe 130.

As will be described in greater detail below, the liner 118, incorporating the coupling 126, is made up on the drilling unit 104. The inner string 124 is then made up and lowered into the liner 118 and the lower end of the string 124 engaged with the coupling 126. The upper end of the inner string 124 is then coupled to the upper end of the liner 118, via the running tool 120. The resulting tubing assembly 132 is then run into the bore 108, supported by the running tool 120 and the running string 122. The liner 118 may be top filled before being lowered into the bore 108.

Fluid may be pumped down the running string 122 and the inner string 124, and then out of the lower end of the liner 118, as the tubing assembly 132 is run into the bore 108.

Once the liner 118 has been run in to target depth, a liner hanger 134 provided at the upper end of the liner 118 is set by applying hydraulic pressure via the running string 122 and the inner string 124. The liner hanger 134 engages the surrounding casing 114*d*. Pressurizing the inner string 124 is achieved by first dropping a ball 136 (FIG. 6) from surface to land in the coupling 126 to occlude the lower end of the inner string 124, and then increasing the pressure above the ball 136. As will be described in detail below and with reference to the additional figures, the ball 136 may then be displaced downwards to allow circulation of fluid to recommence. The circulation of the cementing fluid train, for example including well conditioning drilling fluid/mud, chemical washes, a cement spacer, and appropriate fluid separation members, may then proceed, ultimately allowing cement slurry 138 to be circulated into the bore 108 to fill and seal the annulus 140 between the liner 118 and the surrounding bore wall.

Figure 2:
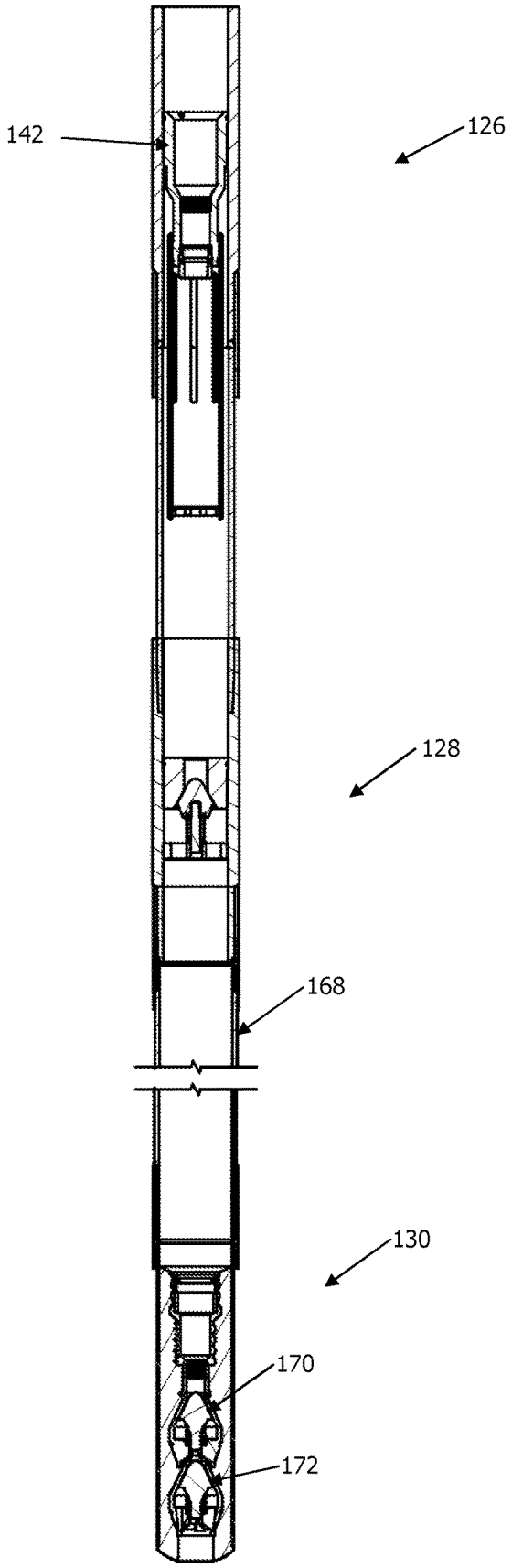
FIG. 2 is a sectional view of a lower end of bore-lining tubing including a float shoe and a float collar and provided with a coupling of the apparatus of FIG. 1.
Figure 3:
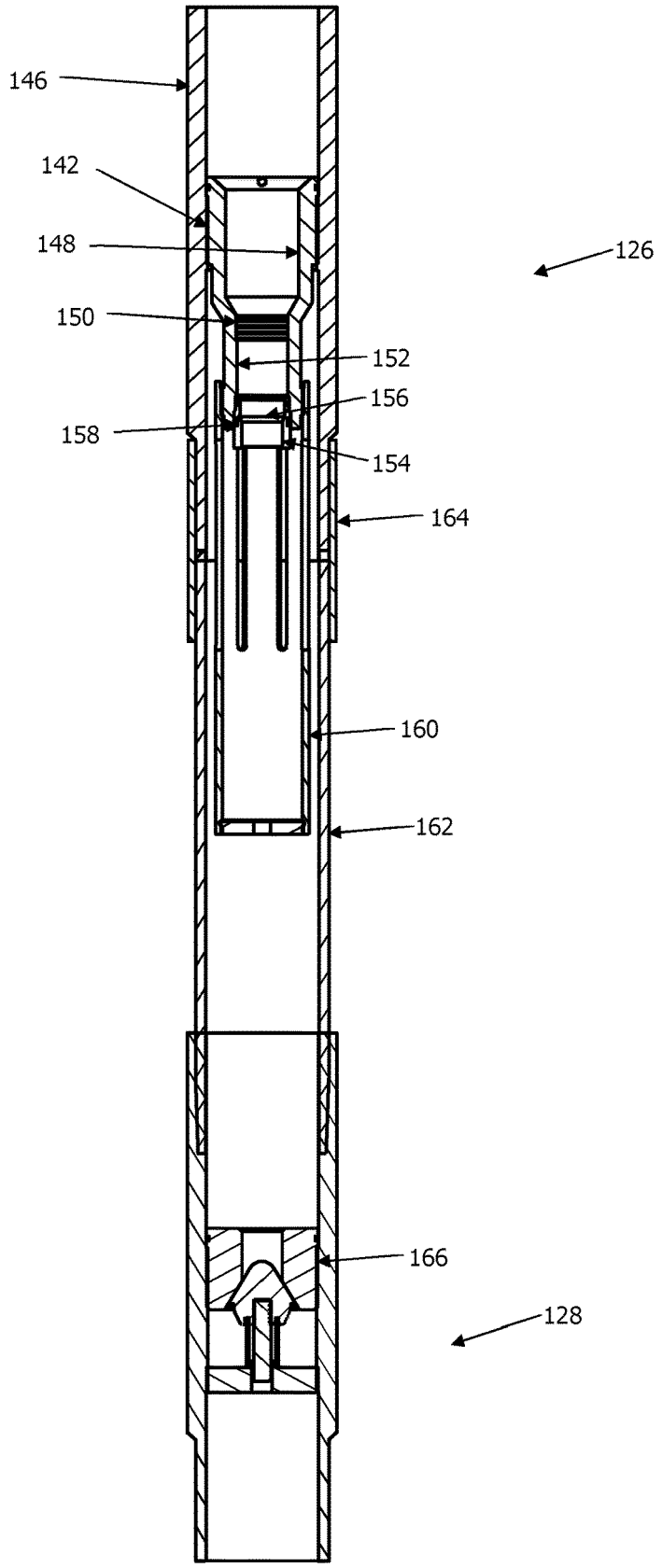
FIG. 3 is a sectional view of the coupling and the float collar of FIG. 2.

Reference is now also made to FIGS. 2 and 3 of the drawings, enlarged sectional views of a lower end of a liner string, including the lower end of the liner 118, the coupling 126, float collar 128, and float shoe 130 (FIG. 2). The coupling 126 provides a female latch-in receiver 142 for a male latch-in 144 (FIG. 4) provided on the leading end of the inner string 124. The receiver 142 is located within a tubular member 146 at the lower end of the string 118 and comprises an upper section with a polished bore 148 and then necks inwards to a hold-down slip profile 150 and a plug receiver 152 incorporating a no-go profile. The latch-in receiver 142 is secured and sealed to the body member 146 by a suitably secure arrangement, for example by connecting threads, cooperating profiles and seals. A ball seat holder 154 containing a ball seat 156 is mounted within the lower end of the receiver 142 and is retained in position by shear pins 158. A slotted catcher sleeve 160 is mounted externally of and extends beyond the lower end of the receiver 142. The catcher sleeve 160 extends downwards within a connector sleeve 162 which is coupled to lower end of the tubular member 146 by an external connector 164.

The lower end of the connector sleeve 162 is coupled to the upper end of the float collar 128, which includes a single check valve 166 arranged to permit flow down through the valve 166 while preventing upwards flow. A further connector sleeve 168 couples the lower end of the float collar 128 to the upper end of the float shoe 130, which is provided with twin check valves 170, 172. The float shoe 130 forms the leading end of the liner string.

Figure 4:
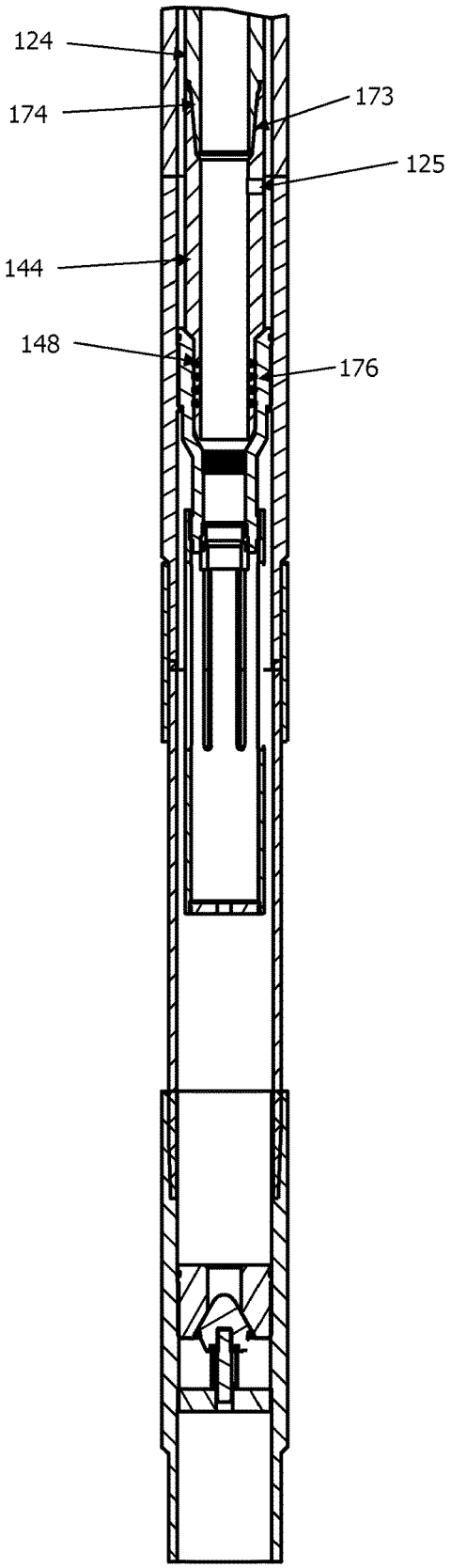
FIG. 4 is a sectional view of the coupling and float collar of FIG. 3 and further including the lower end of an inner string which has been latched into the coupling.
Figure 5:
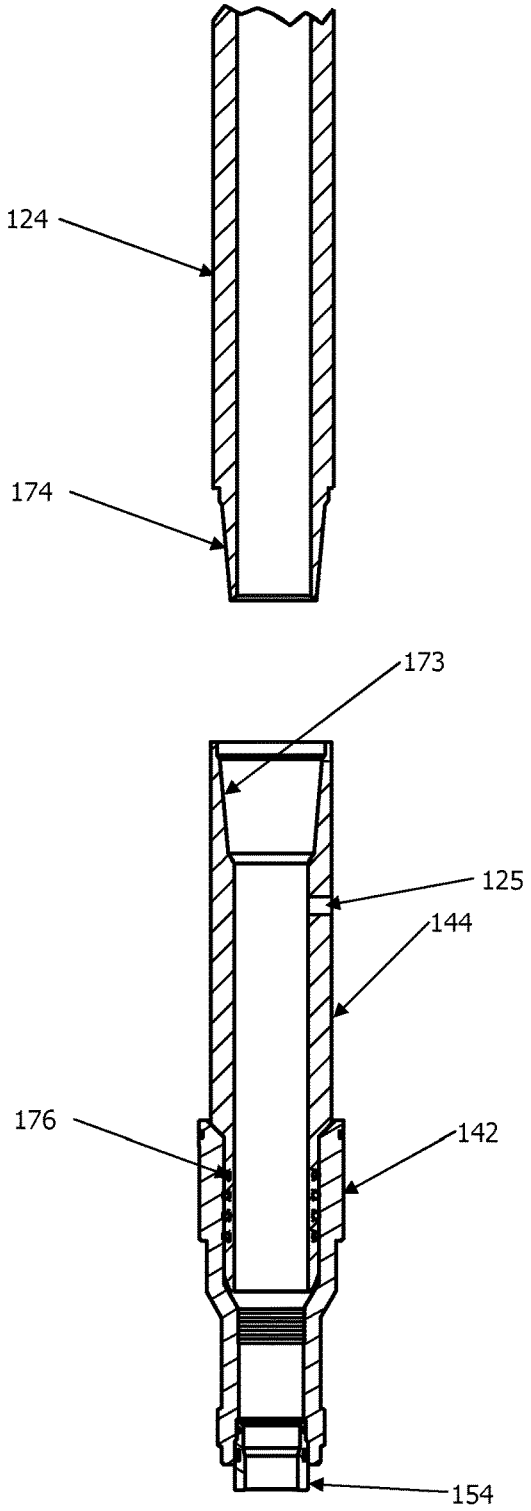
FIG. 5 is a sectional, exploded view of part of the coupling and inner string of FIG. 4.

Reference is now also made to FIGS. 4 and 5 of the drawings. FIG. 4 illustrates the engagement between the lower end of the inner string 124 and the lower end of the liner 118, while FIG. 5 is an enlarged and partially exploded view illustrating the engagement of the latch-in 144 provided on the lower leading end of the inner string 124 with the latch-in receiver 142 provided on the lower end of the liner 118.

The latch-in 144 is tubular and has a box connection 173 for coupling with a pin connection 174 at the leading end of the inner string 124, which may be formed of drill pipe. The leading end of the latch-in 144 has a reduced outer diameter and carries bi-directional circumferential seals 176 such that the latch-in 144 may be axially translated into sealing engagement with the latch-in receiver polished bore 148.

As the coupling 126 incorporating the latch-in receiver 142 is provided at the lower end of the liner 118, and the latch-in 144 is provided on the lower end of the inner string 124, the ends of the liner 118 and the string 124 are effectively coterminous, such that the bore of the inner string extends to the end of the liner 118.

Reference will now also be made to FIGS. 6, 7, 8 and 9, sectional views of the apparatus of FIGS. 2 to 5 illustrating a sequence of steps of a cementing method according to an example of an aspect of the present disclosure. As described above, the liner string, incorporating the liner 118 and the coupling 126, is made up on the drilling unit 104. The inner string 124 is then made up and lowered into the liner 118 and the latch-in 144 on the lower end of the string 124 engaged with the latch-in receiver 142 in the coupling 126. The resulting tubing assembly 132 is then run into the bore 108, supported by the running tool 120 and the running string 122. If desired by the operator, fluid may be pumped down the running string 122 and the inner string 124, through the check valves 166, 170, 172, and then out of the lower end of the liner string, via the float shoe 130. The tubing assembly 132 may also be rotated as the assembly 132 is run into the bore 108. Such rotation may be useful in reducing axial friction between the assembly 132 and the surrounding bore wall and may assist in dislodging or disturbing obstructions in the bore 108; this may be particularly useful as the assembly 132 is being advanced through an inclined or horizontal portion of unlined or open bore section, beyond the distal end of the innermost casing 114*d*.

An equalizing port 125 is provided in the wall of the inner string 124 to provide pressure equalization between the inner string bore and the annulus 196 between the inner string 124 and the liner 118.

Figure 6:
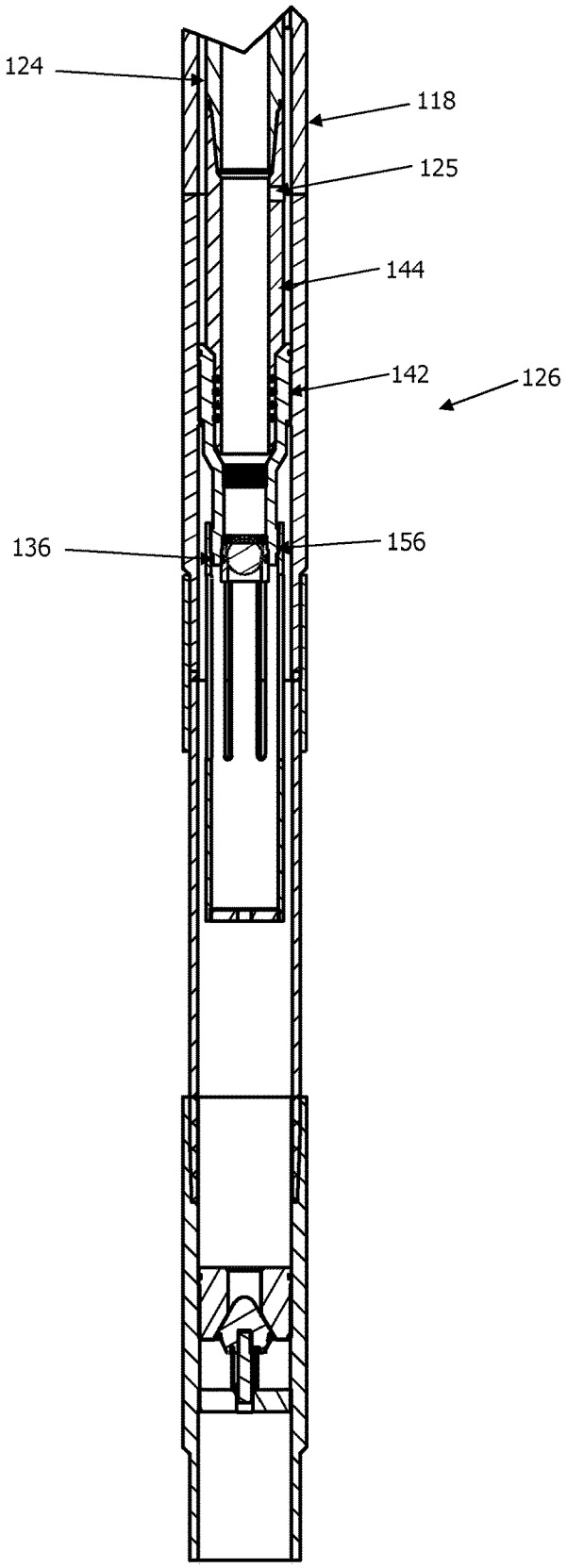
FIGS. 6, 7, 8 and 9 are sectional views of the apparatus of FIGS. 2 to 5 illustrating a sequence of apparatus configurations in a cementing method according to an example of an aspect of the present disclosure.

Once the liner string has been run in to target depth, the operator will set the liner hanger 134 at the upper end of the liner 118. The liner hanger 134 is fluid-pressure actuated and the hanger 134 is in fluid communication with the bore through the inner string 124. Accordingly, the liner hanger 134 may be set by pressurizing the inner string 124. This is achieved by dropping a ball 136 from surface, the ball 136 dropping or being pumped through the running string 122 and the inner string 124 to land in the ball seat 156 in the coupling 126 provided at the lower end of the liner 118, as illustrated in FIG. 6. The ball 136 thus occludes the inner string 124, allowing the operator to increase the pressure in the string 124 above the ball 136 and thus set the liner hanger 134.

Figure 7:
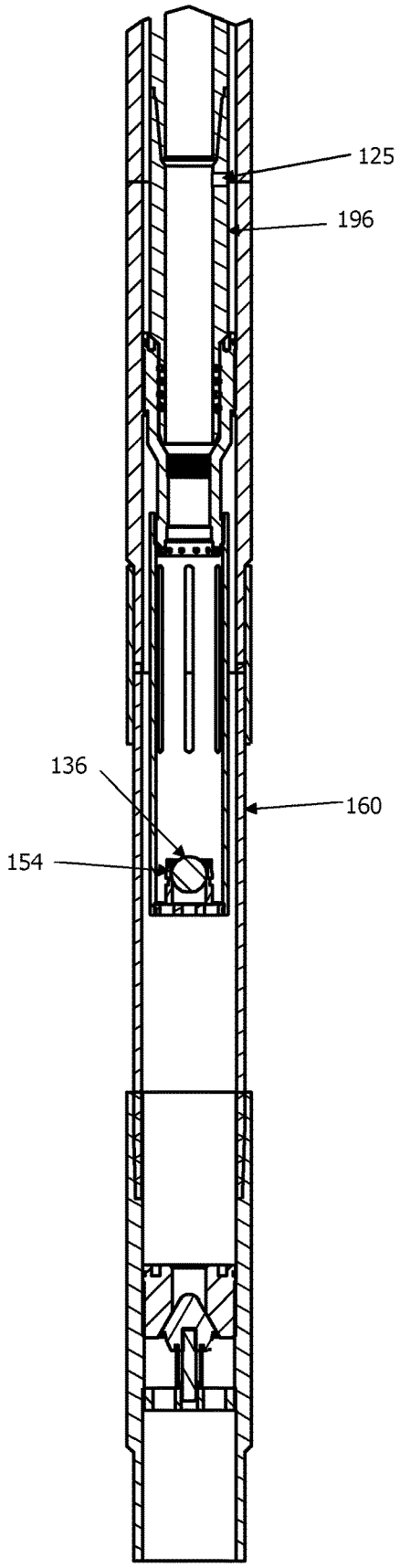
Figure 8:
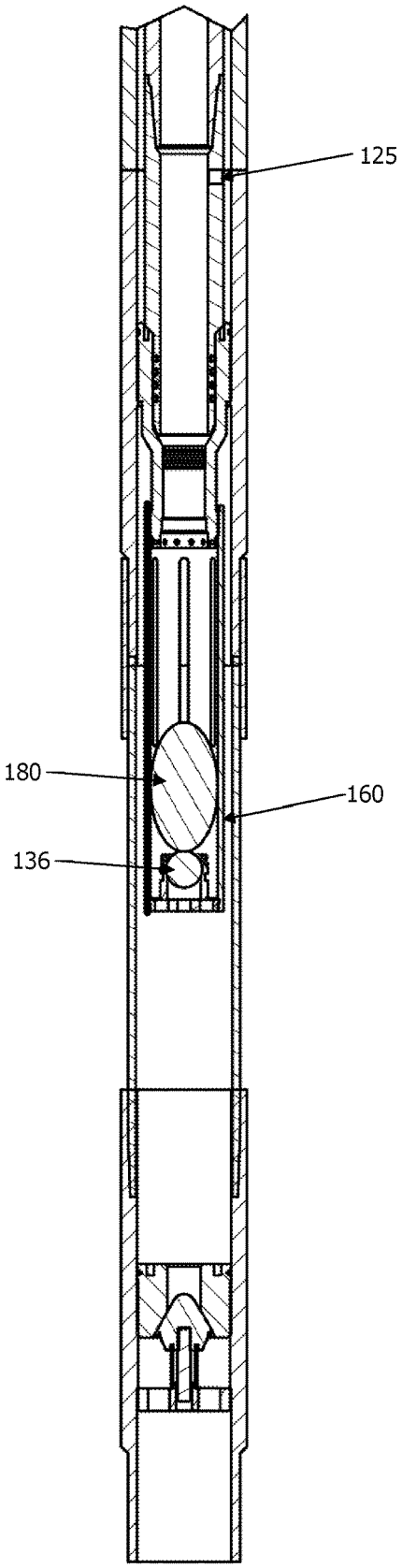
Figure 10:
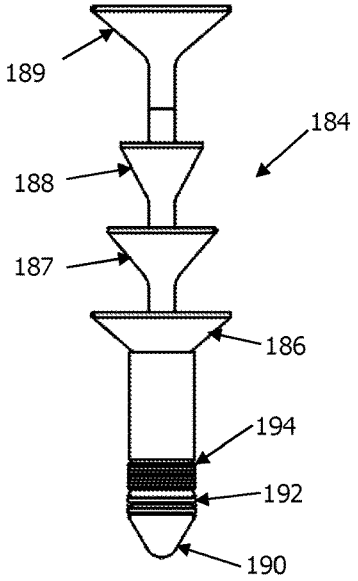
FIG. 10 shows a wiper-plug adapted for landing in and sealing the coupling.

To reinstate fluid circulation the operator then applies an overpressure to the bore of the running string 122 and the inner string 124. This creates a fluid pressure force across the ball 136 and at a predetermined level the force will be sufficient to shear the pins 158 that retain the ball seat retainer 154 in the latch-in receiver 142. The retainer 154 and ball 136 will then drop to the lower end of the slotted catcher sleeve 160 (FIG. 7). The circulation of the cementing fluid train may then proceed.

The components or constituents of the cementing fluid train, and the order in which the different components are pumped into the bore 108, may vary, and may include well conditioning drilling fluid/mud, chemical washes, a cement spacer, cement slurry and cement displacement fluid. A mechanical barrier may be provided between the different fluids. The mechanical barriers may take any appropriate form and, in addition to prevent or limiting cross-mixing or contamination, may also serve to clean or wipe the inner surface of the inner string 124. In the illustrated example mechanical barriers in the form of foam or sponge balls 180, 182 have been employed and are translated down the inner string 124 to land in the slotted catcher sleeve 160. The fluid flowing behind the balls 180, 182 is then free to flow through the slots in the sleeve 160, between the sleeve 160 and the surrounding connector sleeve 162 and out of the end of the liner 118, via the float shoe 130.

Figure 9:
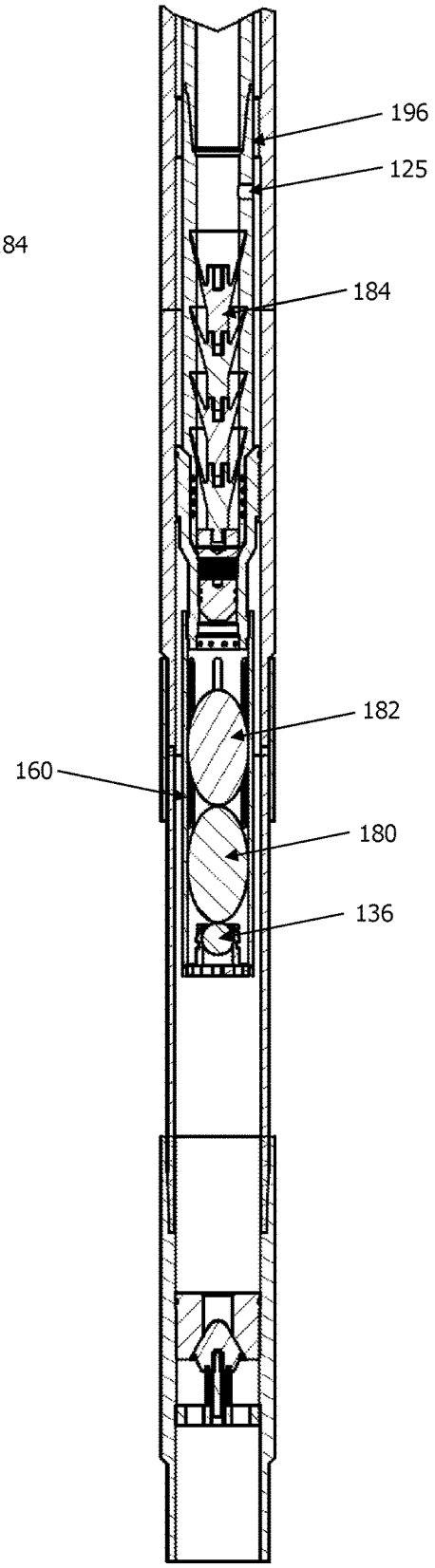

FIG. 9 illustrates the catcher sleeve 160 containing two balls 180, 182, but those of skill in the art will recognize that a longer sleeve could be provided if it were desired to accommodate three or more balls. However, balls formed of compressible materials such as foam and sponge will tend to be compressed, compacted, and eroded by fluids and cement flowing through the sleeve 160, such that a catcher sleeve 160 will readily accommodate a relatively large number of such compressible balls.

When the volume of cement slurry 138 is pumped into the bore 108 a wiper plug 184 is placed behind the cement and separates the cement 138 from the following displacement fluid. The trailing end of the plug 184 includes four axially spaced wiper fins 186, 187, 188, 189 having different sealing diameters to provide a sliding seal with the different diameter portions of the running string 122 and inner string 124.

The cement slurry 138 passes from the end of the inner string 124 and through the latch-in 144, and then through the latch-in receiver 142 mounted at the end of the liner 118, and into the catcher sleeve 160. The cement slurry 138 then passes through the slots in the catcher sleeve 160, through the connector sleeve 162, the float collar 128 and the float shoe 130. Thus, there is no contact between the cement slurry 138 and the inner surface of the liner 118, and there is only a very small section of the liner string that is not swept by the various balls 180, 182 and the wiper plug 184; the connector sleeve 162 is likely to be less than 1 meter long. This has a beneficial effect on the quality of the cement slurry that enters the annulus 140 between the liner 118 and the surrounding bore wall, as the possibility of contamination by residual fluids and material in the liner string is effectively eliminated.

The leading end of the plug 184 features a rounded nose 190, circumferential seals 192 to engage with the plug receiver 152, and bi-directional hold-down split slips 194 to engage with the hold-down slip profile 150. On passing into the coupling 126 the wiper plug 184 travels as far as the plug receiver no-go diameter and is anchored into the latch-in receiver 142. The anchored plug 184 thus prevents any further flow of fluid out of the end of the liner 118, and also serves to prevent flow of fluid back into the inner string 124 in the event of a failure of the check valves 166, 170, 172.

As is apparent from FIG. 9, the leading end of the landed plug 184 extends from the end of the latch-in 144 and is locked into the coupling 126, and thus secured to the lower end of the liner 118. The trailing end of the plug 184 remains within the latch-in 144, at the end of the inner string 124.

Where the wiper plug 184 is a certifiable barrier (an ISO V-rated barrier), the provision of the locked-in wiper plug 184 in combination with the check/float valves 166, 170, 172 may provide the operator with the additional comfort of providing two deemed barriers at the completion of the cement job.

With the wiper plug 184 locked in place the pressure in the inner string 124 may be increased to operate other tools or apparatus, such as to open a valve provided with a burst disc and providing for fluid circulation from the inner string 124 into an annulus 196 between the inner string 124 and the liner 118.

Following the disengagement of the running tool 120 from the upper end of the liner 118, the inner string 124 may be retrieved to surface by separating the latch-in 144 from the latch-in receiver 142. The engagement and disengagement of the latch-in 144 may be facilitated by the provision of an arrangement for selectively transmitting torque through the inner string 124 as described in applicant's WO2017103601, the disclosure of which is incorporated herein in its entirety.

On retrieving the inner string 124, the latch-in receiver 142 and the wiper plug 184 are retained in the bore, and of course the liner 118 remains in the bore, with the annulus 140 around the liner 118 filled with cement, and with no cement inside the liner 118. The operator may then choose to drill out the wiper plug 184 and the small volume of cement remaining in the lower end of the liner string beyond the end of the liner 118 and below the wiper plug 184, and some or all of the apparatus provided at the end of the liner string, such as the coupling 126, the catcher sleeve 160, and the check valves 166, 170, 172.

After the wiper plug 184 has landed in the latch-in receiver 142, there is no contact between the inner string 124 and the cement which has been pumped into the bore. Thus, if desired, the inner string may be retrieved from the bore before the cement has set. Further, irrespective of when the inner string 124 is retrieved, the cement will not interfere with the separation of the string 124 from the liner assembly.

As noted above, the retrieved inner string 124 will be substantially free of cement, and thus the drill pipe sections and other tubulars which form the string 124 may be reused without requiring drifting or extensive cleaning.

The apparatus 102 thus allows an operator to selectively pressure up the running string 122 and the inner string 124 by locating an occluding member, in the form of the ball 136, in the flow passage between the inner string 124 and the exterior of the liner 118. The occluding member may subsequently be displaced to permit passage of other members through the inner string 124 to a location towards the distal end of the liner assembly, and beyond the lower or distal end of the liner 118.

The provision of an inner string 124 to deliver fluid to the end of the liner 118, and the ability to separate fluids on the inner string 124 using foam balls, plugs and the like, limits or prevents cross-contamination and facilitates cleaning of the inner string wall. Further, if the operator chooses to drill out the latch-in receiver 142 and some or all of the other apparatus below the receiver 142, there is only a relatively small volume of material to be removed, and only a relatively small volume of cement in and around the apparatus 102.

The apparatus 102 of this example includes both a float shoe 130 and a float collar 128. In other examples the float collar 130 or the float shoe 128 could be omitted, or other arrangements could be provided for controlling flow into and from the bore-lining tubing. For example, other arrangements may provide for fluid to pass up into the inner string 124, and into the annulus 196 between the inner string 124 and the liner 118, as the assembly 132 is run into the bore 108 to facilitate self-filling of the strings 122, 124 and the displacement of fluid from the volume below the assembly 132, or check valves provided towards the lower end of the bore-lining tubing may initially be held open.

In other arrangements the ball seat 156 could be located at a more proximal location, for example just a short distance below the liner hanger 134. Following the setting of the hanger 134 the ball 136 could be displaced, for example by squeezing a deformable ball through the seat 156, or by releasing the ball seat holder 154. The ball 136 and/or holder 154 could then be translated down through the inner string 124 to provide a clear passage for subsequent members such as foam balls and plugs.

In other examples the ball 136 could be replaced by a dart or plug. Such a dart or plug could be deformed or reconfigured to pass through the ball seat 156. Further, the illustrated ball seat holder 154 and ball seat 156 are releasably secured to the latch-in receiver 142 by shear pins 158. In other examples alternative releasable members may be utilized, or the ball seat 156 may be configured to yield, extrude, expand, rotate or otherwise deform or reconfigure to permit passage of the ball 136 or other occluding member.

In other examples the catcher could simply be a volume towards the lower end of the tubing assembly 132 where balls, darts, plugs and the like may be accommodated while not obstructing or preventing the flow of fluid through the assembly 132.

In the illustrated example the cement slurry and following displacement fluid are separated by a wiper plug 184, which is then anchored in the latch-in receiver 142 to prevent further flow through or into the tubing assembly. In other examples a member other than a wiper plug 184 may provide this function.

In the illustrated example the apparatus and methods of the disclosure employ a mobile offshore drilling unit 104 in an offshore sub-sea environment. The skilled person will of course recognize that the apparatus and methods may be deployed from other vessels and structures, such as an offshore platform, and of course may also be utilized in onshore/land-based operations.

As noted on the above description, one feature of an aspect of the disclosure is the ability to provide an additional barrier at the distal end of the bore-lining tubing following the delivery of the cement slurry 138 into the bore 108 (in the illustrated example the wiper plug 184, in combination with the check/float valves 166, 170, 172). The skilled person will recognize that a different arrangement of barriers may be utilized to provide this feature.

For ease of illustration, the example well 100 features a vertical bore 108. However, it will be recognized that the apparatus and methods could equally be utilized in deviated or horizontal bores, or in a well including any combination of such bore inclinations.

In the example illustrated in FIG. 1, the inner string 124 and the liner 118 are shown in a coaxial relationship, and for some applications this will be the preferred relationship. Indeed, stabilizers or other centralizing arrangements may be provided on the liner 118 to maintain that relationship, particularly if the tubing assembly 132 is to be located in an inclined or horizontal bore, or when the tubing assembly 132 is to be rotated as the assembly 132 is run in to target depth or to facilitate mud displacement and cement distribution as the cement slurry 138 is being pumped into the annulus 140 surrounding the liner 118. However, in other situations, and in accordance with another aspect of the disclosure, an offsetting of the inner string 124 within the liner 118 may be desirable, as described below.

Figure 11:
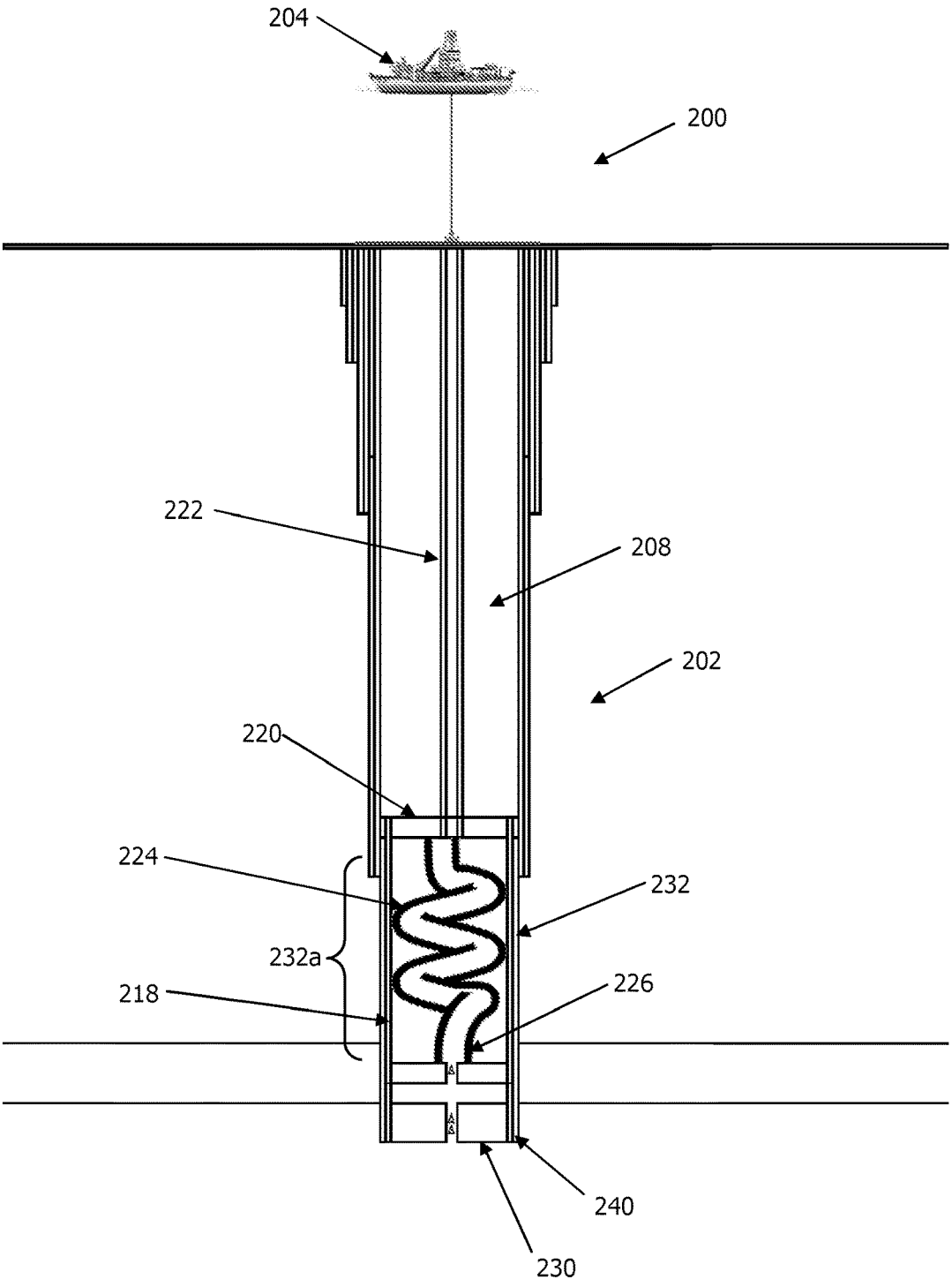
FIG. 11 is a schematic of an oil and gas well including apparatus in accordance with an example of a further aspect of the present disclosure.

Reference is now made to FIG. 11 of the drawings, a schematic of an oil and gas well 200 including apparatus 202 in accordance with an example of a further aspect of the present disclosure. The apparatus 202 shares many features with the apparatus 102 described above, and in the interest of brevity many of the common features will not be described again in substantial detail.

As has been mentioned above, in some operations it may be desirable to rotate a tubing assembly 232 as the assembly 232 is run into a bore 208, or once the assembly 232 is at target depth. While running in, such rotation may reduce axial friction between the assembly 232 and the bore wall, and the rotation at the float shoe 230, which may be configured as a reaming shoe, may be effective in removing ledges in the wall of the bore 208, advancing the assembly 232 through swelling formations, or dislodging debris that has gathered on the low side of an inclined or horizontal bore. The inner string 224 is coupled to the liner 218 at the coupling 226 provided towards the lower end of the tubing assembly 232, and also via the running tool 220, at the upper end of the assembly 232. In a conventional arrangement, there would be no coupling of the liner 218 and the inner string 224 over the intermediate portion of the assembly 232*a*.

When a tubing assembly comprising coaxial tubing strings is rotated there is a possibility that the smaller diameter inner string, or at least portions of the inner string, will rotate at a different speed to the larger diameter outer string. The differential rotation may be transitory, for example as rotation is initiated, or as rotation is stopped.

This differential rotation may have the undesirable effect of loosening or backing off threaded connections between elements of the strings, or of inducing metal fatigue in elements of the strings. These effects may be particularly apparent in the inner string and can be disruptive to a liner running and cementing operation. For example, if a threaded connection in the inner string backs-off and loses pressure integrity, attempting to pump fluid or cement through the inner string will likely result in leakage of the fluid/cement into the inner annulus and may even result in the connection washing-out and failing completely. Accordingly, in the event of such a loss in pressure integrity the operator will likely have to retrieve the tubing assembly to surface, disconnect and disassemble the inner string, check all of the inner string connectors, reassemble the inner string, reconnect the inner string to the liner, and then run the reassembled tubing assembly back into the well.

In this example these difficulties may be avoided or minimized by locking an intermediate portion of the inner string 224 relative to the liner 218 to prevent relative rotation between the strings 224, 218. In the illustrated example this is achieved by inducing helical buckling in the inner string 224. This results in an elastic deformation of the string 224, to a helical form, and whereby a substantial portion of the length of the inner string 224 is in contact with the inner surface of the liner 218. This contact rotationally locks the two tubing strings 224, 218, such that when the tubing assembly 232 is rotated the strings 224, 218 will rotate in unison.

The tubing assembly 232 is made up in a manner which is generally similar to the making-up of the assembly 132 described above. Thus, the liner 218, incorporating a coupling 226, is made up on the drilling unit 204. The inner string 224 is then made up and lowered into the liner 218 and the lower end of the string 224 engaged with the coupling 226. However, then, with the upper end of the liner 218 securely held and supported in the drilling unit 204, additional pipe sections are added to the upper end of the string 224 and the inner string 224 axially compressed. This axial compression initially induces a sinusoidal buckling of the string 224; the string 224 assumes a two-dimensional waveform shape resembling a sine wave. Addition of further pipe sections and further compression will then induce helical buckling; the string 224 assumes a three-dimensional shape as a helix or coil, as illustrated schematically in FIG. 11. The coiled string 224 is radially restrained by the liner 218 and the helically buckled string 224 is now locked to the liner 218. While this compression of the string 224 is maintained, the upper end of the inner string 224 is coupled to the upper end of the liner 218, via the running tool 220. The resulting tubing assembly 232 is then run into the bore 208.

If the tubing assembly 232 is rotated while being run into the bore 208, or while fluid or cement slurry is being circulated through the annulus 240, the inner string 224 and the liner 218 are locked together over the length of the assembly 232 and the strings 224, 218 will rotate at the same speed, ensuring the integrity of the connections between the pipe sections forming the inner string 224 is maintained.

The skilled person will understand that the helical form illustrated in FIG. 11 is schematic, and that the wavelength and amplitude of a helically buckled inner string 224 formed of conventional drill pipe sections and radially restrained within a section of bore-lining tubing such as casing or liner 218 will be such that balls, darts, plugs and other members will still pass easily through the coiled string 224.

When it is desired to retrieve the inner string 224 from the cemented liner 218, the running tool 220 is disengaged from the upper end of the liner 218. This may be sufficient to allow the elastically buckled inner string 224 to extend and straighten, or the operator may apply tension to the upper end of the string 224, via the running string 222. As the inner string 224 is axially extended the string 224 will return to a rectilinear form, and on straightening the string 224 will come out of contact with the inner surface of the liner 218. The inner string 224 may then be rotated to separate the lower end of the string 224 from the coupling 226, and the string 224 retrieved to surface.

By using the method of this example, the operator may lock the inner string 224 and the liner 218 together using conventional apparatus, simply by compressing and deforming the string 224. The helical buckling of the string 224 is particularly effective as this form of deformation creates a relatively large area of contact between the strings 224, 218.

In other examples, different means may be employed to prevent or limit differential rotation between the inner string and the surrounding larger diameter tubing. For example, rather than relying on helical buckling of the inner string, an operator may include elements in the inner string that facilitate deformation or misalignment and thus bring portions of the inner string into contact with the surrounding tubing. Such elements may include relatively flexible subs or pipe sections, or swivel joints. Alternatively, or in addition, the operator may incorporate expandable stabilizers or centralizers in the string, the stabilizers responding to compression or elevated inner string pressure to expand into contact with the surrounding liner.

The illustrated examples describe tubing assemblies being run into a pre-drilled bore section. In other examples the tubing assembly could be employed while drilling with casing. In such an operation a casing string or liner, including an inner string, and provided with an appropriate drill bit at the distal end, is utilized to drill a portion of the bore that the casing string or liner will line. Where possible, the ability of the operator to drill, ream, run, set, and cement the casing string or liner in a single trip may provide considerable savings in both time and money.

In the examples described above there is an inner annulus defined between the inner string 124, 224 and the surrounding liner 118, 218. This annulus may be filled with fluid as the tubing assembly 132, 232 is made up, for example the annulus may be top filled with drilling fluid. Alternatively, the annulus may be at least partially filled with a lower density material or liquid, such as a lower density hydrocarbon, or may be at least partially filled with air or another gas. The annulus may be provided with a divider such that, for example, a lower portion of the annulus may be filled with air, while an upper portion of the annulus may be filled with drilling fluid.

As described in detail in applicant's GB2592937A, the provision of the lower density material provides the tubing assembly 132, 232 with a degree of buoyancy. This may reduce the friction between the assembly 132, 232 and a surrounding bore wall, particularly in inclined or horizontal bores, and may prove particularly useful when drilling with casing, that is the distal end of the assembly 132, 232 is provided with an appropriate drill bit and is utilized to drill a portion of the bore that the casing string or liner will line.

The aspects of the disclosure described herein may be combined with the apparatus and methods disclosed in applicant's previous patent publications including, for example, GB2545495, WO2017103601, WO2018042148, GB2565098, WO2019025798, WO2019025799, GB2586585, and GB2592937, the disclosures of which are incorporated herein in their entirety.

The skilled person will appreciate that the examples illustrated and described herein are merely exemplary of the disclosure. The illustrated examples relate to the cementing of bore-lining tubing in the form of a liner, but the apparatus could equally be used in cementing casing. The apparatus and methods could also be used in other downhole operations involving delivery or circulation of fluids and are not limited to use in the delivery of cement slurry. For example, the apparatus and methods may be utilized in drilling operations for accessing aquifers and other water-bearing formations, and drilling operations for accessing subterranean formations for fluid storage, disposal, injection, or geothermal recovery.

The invention claimed is:

1. A tubing assembly, comprising:

a bore-lining casing;

a bore-lining tubing extending from the bore-lining casing;

an inner string; and a downhole coupling for connecting a lower end of the inner string to a lower end of the bore-lining tubing, wherein the downhole coupling is disposed within the lower end of the bore-lining tubing, and includes a female member configured to receive a male extension of the lower end of the inner string, and a catcher; and wherein the downhole coupling is configurable to permit separation of the lower end of the inner string from the lower end of the bore-lining tubing, wherein the inner string is retrievable from a bore while the bore-lining tubing, the coupling and the catcher remain in the bore; and wherein the coupling is in combination with at least one member for translating through the inner string and landing in the catcher.

2. The tubing assembly of claim 1, wherein the at least one member is an occluding member for occluding a flow passage through the coupling, and wherein the coupling includes a seat for cooperating with an occluding member, and wherein the occluding member is displaceable to the catcher.

3. The tubing assembly of claim 1, wherein the at least one member is at least one of a string cleaning member and a fluid-separating member for location between two different fluids.

4. The tubing assembly of claim 1, wherein the coupling is in combination with a wiper plug for translating through the inner string and wherein the wiper plug is adapted to be retained in the coupling, occlude the inner string, and prevent fluid from flowing from the inner string and out of the end of the bore-lining tubing, wherein the wiper plug includes anchoring portions to secure the wiper plug in the coupling; and wherein the wiper plug is adapted to remain in the coupling and occluding the lower end of the bore-lining tubing on separation of the lower end of the bore-lining tubing and the lower end of the inner string.

5. The tubing assembly of claim 1, wherein the male extension of the lower end of the inner string is a latch-in is provided on the lower end of the inner string, and the female member is a latch-in receiver is provided on the lower end of the bore-lining tubing;

wherein the latch-in receiver is adapted to receive and retain a wiper plug; and wherein the catcher is in the lower end of the bore-lining tubing, below the latch-in receiver.

6. The tubing assembly of claim 1, wherein the inner string has a smaller outer diameter than an inner diameter of the bore-lining tubing such that an annulus is defined between the strings, and a pressure equalizing port is provided in the inner string between a bore of the inner string and the annulus.

7. A downhole method comprising:

(a) mechanically coupling a lower end of an inner string to a lower end of a bore-lining tubing using a downhole coupling to form a tubing assembly, the bore-lining tubing extending from a bore-lining casing; then (b) translating at least one member through the inner string and the downhole coupling to a catcher in the lower end of the bore-lining tubing, and then (c) flowing fluid through the inner string and out of the bore-lining tubing.

8. The method of claim 7, further comprising running the tubing assembly into a drilled bore to locate the bore-lining tubing at a target depth in the bore.

9. The method of claim 8, further comprising uncoupling the lower end of the inner string from the lower end of the bore-lining tubing and retrieving the inner string from the bore while the bore-lining tubing and the catcher remain in the bore.

10. The method of claim 7, wherein the at least one member is an occluding member and further comprising:

locating the occluding member at an occluding location in the tubing assembly and occluding fluid flow through the tubing assembly; and pressurizing the inner string above the occluding location to activate or actuate a tool.

11. The method of claim 10, further comprising:

pressurizing the inner string above the occluding location to activate a tubing hanger to secure an upper end of the bore-lining tubing to previously installed tubing; and translating the occluding member from the occluding location and reinstating flow through the tubing assembly;

wherein the occluding location is located towards the lower end of the tubing assembly;

further comprising one of: displacing the occluding member through a seat and displacing the occluding member and a seat.

12. The method of claim 7, wherein the at least one member is a string cleaning member and further comprising translating the cleaning member through the inner string;

wherein the at least one member is a fluid-separating member and further comprising translating the fluid-separating member through the inner string between two volumes of fluid;

further comprising locating the fluid separating member between at least one of: a bore-conditioning fluid and a chemical wash; a chemical wash and a cement spacer fluid; a cement spacer fluid and a cement slurry, and a cement slurry from a displacement fluid.

13. The method of claim 7, wherein the at least one member is a wiper plug and further comprising:

translating the wiper plug through the inner string to occlude the string and prevent further fluid from flowing from the inner string and out of the end of the bore-lining tubing;

locating the wiper plug between a cement slurry and a displacement fluid;

flowing cement slurry through the inner string and out of the lower end of the bore-lining tubing without the cement slurry contacting an inner diameter of the bore-lining tubing; and anchoring the wiper plug in the lower end of the bore-lining tubing.

14. The method of claim 7, further comprising:

(d) running the tubing assembly into a bore with the assembly configured to permit circulation of fluid down through the inner string and out of the lower end of the bore-lining tubing;

(e) locating the at least one member in the tubing assembly to prevent flow of fluid through the inner string and out of the lower end of the bore-lining tubing;

(f) configuring the assembly to permit the circulation of fluid and to permit passage of the at least one member into the catcher; and (g) configuring the assembly to prevent flow of fluid out of the lower end of the bore-lining tubing and to prevent flow of fluid into the lower end of the bore-lining tubing.

15. The method of claim 14, further comprising:

at step (d), circulating fluid down through the inner string and out of the lower end of the bore-lining tubing:

at step (e), pressurizing the inner string; further comprising pressuring the inner string to actuate a device operatively associated with the tubing assembly; and at step (f), circulating fluid and translating a member through the inner string and to the end of the bore-lining tubing.

16. The method of claim 14, wherein the member at least one of cleans the inner string and separates two different fluids in the inner string further comprising:

at step (g), translating a wiper plug through the inner string to occlude the string and prevent fluid from flowing from the inner string and out of the end of the bore-lining tubing;

separating cement slurry and a displacement fluid with the wiper plug;

at least one of anchoring the wiper plug in the lower end of the bore-lining tubing with a bidirectional anchoring arrangement and sealing the wiper plug in the lower end of the bore-lining tubing with a bi-directional sealing arrangement.

17. The method of claim 16, further comprising uncoupling the lower end of the inner string from the lower end of the bore-lining tubing and retrieving the inner string from the bore while the wiper plug and the bore-lining tubing remain in the bore.

18. The method of claim 7, further comprising configuring the assembly whereby a portion of the inner string intermediate the upper and lower ends contacts the bore-lining tubing.

19. The method of claim 7, further comprising rotating the tubing assembly in a bore.

* * * * *